US005657677A

United States Patent [19]

Cuir et al.

[11] Patent Number: 5,657,677

[45] Date of Patent: Aug. 19, 1997

[54] APPARATUS HAVING AN INTERCHANGEABLE COVERING FOR CUTTING SEMI-RIGID SHEETS ONE BY ONE, IN PARTICULAR SHEETS OF CARDBOARD

[75] Inventors: Jean-Pierre Cuir; Gérard Cuir, both of Villeneuve d'Ascq, France

[73] Assignee: Etablissements Cuir, France

[21] Appl. No.: 228,439

[22] Filed: Apr. 15, 1994

[30] Foreign Application Priority Data

Apr. 16, 1993 [FR] France ..... 93 04721

[51] Int. Cl.[6] ..... B26D 1/56; B26D 5/00

[52] U.S. Cl. ..... 83/74; 83/76.9; 83/284; 83/318; 83/367; 83/509; 83/659

[58] Field of Search ..... 83/74, 76.1, 76.9, 83/284, 285, 318, 347, 367, 509, 659

[56] References Cited

U.S. PATENT DOCUMENTS

| | | | |
|---|---|---|---|
| 3,695,132 | 10/1972 | Cuir et al. | 83/284 X |
| 3,699,831 | 10/1972 | Mowry | 83/284 X |
| 4,453,436 | 6/1984 | Tokuno | 83/74 X |
| 5,111,724 | 5/1992 | Kanaga et al. | 83/509 X |
| 5,297,461 | 3/1994 | Hirakawa et al. | 83/659 X |

*Primary Examiner*—Eugenia Jones
*Attorney, Agent, or Firm*—Ladas & Parry

[57] ABSTRACT

The apparatus for cutting semi-rigid sheets one by one, in particular corrugated cardboard sheets, comprises a cutting tool fixed on a tool-carrier plate, a backing cylinder, at least one independent motor having electronic servo-control and rotatable in either direction driving the tool-carrier plate in its reciprocating motion, and device for monitoring rotation of the backing cylinder and connected to a controlling electronic circuit provided with an input for receiving operating parameters including at least the length l of the cutting tool. The electronic circuit is programmed so that the amplitude of the reciprocating motion is a function of the parameter l and so that the linear speed of the tool-carrier plate is constantly equal to the peripheral linear speed of the backing cylinder so long as the cutting tool is in contact with said backing cylinder.

14 Claims, 8 Drawing Sheets

APPARATUS HAVING AN INTERCHANGEABLE COVERING FOR CUTTING SEMI-RIGID SHEETS ONE BY ONE, IN PARTICULAR SHEETS OF CARDBOARD

FIELD OF THE INVENTION

The present invention relates to cutting semi-rigid sheets one by one, in particular sheets made of cardboard and more particularly of corrugated cardboard. More precisely, the invention relates to improved apparatus that is specially adapted to perform such cutting at throughputs that are optimized as a function of the format of the sheet to be cut, and of the dynamics of the machine.

BACKGROUND OF THE INVENTION

A semi-rigid sheet, and in particular a sheet of corrugated cardboard, is cut in conventional cutting machines by using a cutting tool or "die" and a backing surface or "anvil". The cutting tool comprises blades or edges perpendicular to the backing surface when the sheet is compressed between the backing surface and the cutting tool such that the edges pass through the sheet and make the corresponding cuts.

In a first type of cutting machine, the cutting tool is positioned flat on a tool-carrier plate and the backing surface is a plane surface. Under such circumstances, cutting is performed by pressing the backing surface against the tool-carrier plate on which the sheet to be cut has been positioned. The pressure that needs to be used in a cutting machine of that type is very high, sometimes being as great as several thousands of kilonewtons.

In a second type of cutting machine, the cutting tool is mounted on the periphery of a cylinder and the backing surface is itself a cylindrical surface. Cutting is performed by inserting the sheet between the two cylinders that are driven in rotation. The pressure used is much smaller since cutting takes place linearly along the line of tangential contact or "nip" between the two cylinders. However, it is very difficult to shape a cutting tool so that it can be fitted on the outside surface of a cylinder. In addition, problems can arise when the sheet to be cut is quite thick because the cutting edges are mounted radially, so there is a difference in the peripheral distance between the top portions and the bottom portions of two adjacent cutting edges.

In a third type of cutting machine, as disclosed, for example, in document U.S. Pat. No. 3,765,286, the cutting tool is mounted on a tool-carrier plate end the backing surface is a cylindrical surface. That particular disposition makes it possible to mitigate the drawbacks of the first two types. Nevertheless, in that case, the tool-carrier plate must be driven with reciprocating forward-and-return motion enabling each sheet to be displaced one after the other beneath or over the backing cylinder from a sheet feed position to a position for removing the cut sheet. In addition, given that the sheet to be cut comes from an earlier station, either a printing machine or a feeder, the culling machine also includes its own feed means enabling said sheet in particular to be placed accurately on the cutting tool during displacement thereof beneath the backing cylinder. It is necessary firstly for the sheet to be very accurately positioned on the cutting tool, and secondly for it to be impossible for any slip of the sheet to occur as it goes under the backing cylinder. In document FR 2 257 573, the feed means are constituted by two sheet transport systems. The first system, referred to as a "transfer belt" receives the sheet from the upstream machine, which may be a feeder or a printer, for example. It has constant linear speed equal to the speed of said machine. The second machine, referred to as a "launching belt" receives the sheet from the transfer belt and inserts it between the tool-carrier plate and the backing cylinder. Its initial speed is therefore equal to that of the transfer belt, after which it accelerates the sheet so as to give it a speed that is equal to that of the backing cylinder while applying thereto the same acceleration relationship as that which applies to the tool-carrier plate.

In cutting machines of the third type, the backing cylinder includes a covering that is made either of steel or else of a flexible material such as polyurethane. Which one of those coverings is used depends on the quality of cutting that it is desired to obtain. A cleaner cut is obtained when the covering is made of steel, but this causes the cutting edges to wear much more quickly. Such wear can rapidly cause so-called "angel hairs" to be formed, i.e. strips that are very narrow, e.g. about one-tenth of a millimeter wide, and that correspond to the sheet being crushed by a worn cutting blade. The use of a backing cylinder having a steel covering also requires positioning of the cylinder to be adjusted very accurately relative to the tool-carrier plate.

The use of a covering made of flexible material on the backing cylinder makes it possible to avoid "angel hairs" and to avoid the need for accurate adjustment. However, cutting is of poorer quality and cut edges are less clean because of the relative penetration of the cutting edges into the covering of the backing cylinder.

In conventional installations, the quality of cut is a function of the type of cylinder with which the cutting machine is fitted. The user therefore has no way of selecting quality of cut as a function of a particular batch to be treated.

OBJECTS AND SUMMARY OF THE INVENTION

The first object of the invention is to provide cutting apparatus that mitigates the above-mentioned drawback. It provides apparatus for cutting semi-rigid sheets one by one, in particular corrugated cardboard sheets, the apparatus comprising a cutting tool fixed to the tool-carrier plate and a backing cylinder, the tool-carrier plate being driven with forward-and-return reciprocating motion between a first position where the cutting tool is situated in front of the backing cylinder and a second position where it is situated behind the backing cylinder, the sheet being inserted by launching means over the cutting tool when the tool-carrier plate has left the first position, the sheet being cut as it passes under the backing cylinder and then being removed from the cutting tool when the tool-carrier plate is in its second position, wherein the backing cylinder comprises:

a) a chassis and support means suitable for receiving as the backing surface either a steel covering of thickness $d_1$ or else a covering of flexible material of thickness $d_2$;

b) vertical displacement means for displacing the backing cylinder between two positions adjusted for cutting purposes, the first corresponding to the thickness $d_1$, and the second to the thickness $d_2$;

c) at least one first independent motor having electronic servo-control end rotatable in either direction, driving the tool-carrier plate in reciprocating motion, and a second independent motor having electronic servo-control driving the launching means; and d) monitoring means for monitoring rotation of the backing cylinder;

said first and second motors, the monitoring means, and the vertical displacement means for the backing cylinder all being connected to a controlling electronic circuit that has input means for receiving operating parameters including at least the thickness $d_1$ or $d_2$ of the covering;

and wherein said circuit is programmed to control the vertical displacement means for displacing the backing cylinder as a function of the thickness parameter, and for controlling the first and second motors so that the linear speed of the launching means and that of the tool-carrier-plate are equal to the peripheral linear speed of the backing cylinder at the moment when the cutting tool presents the sheet under the backing cylinder, and so that the linear speed of the tool-carrier plate is equal to the peripheral linear speed of the backing cylinder so long as the cutting tool is in contact with said backing cylinder.

Thus, it is possible to interchange the covering of the backing cylinder between two batches of cutting operations. After such a changeover, the operator merely needs to enter into the electronic circuit the parameter corresponding to the thickness of the selected covering. As a result, the backing cylinder automatically takes up the predefined adjustment position and the displacement speeds of the launching means and of the tool-carrier plate are determined so as to take into account the outside diameter of the covering which has an effect on the peripheral linear speed of the backing cylinder, which speed should always be equal to the linear speed of the tool-carrier plate and of the sheet to be cut.

The length 1 of the cutting tool is preferably one of the operating parameters entered into the controlling electronic circuit, and the circuit should then be programmed so that the amplitude of the reciprocating motion of the tool-carrier plate is a function of the parameter 1.

Because of the invention it is thus possible to reduce the stroke of the tool-carrier plate when the format of the sheet to be cut (and thus also the length 1 of the cutting tool) is less than the maximum dimension L provided for by the manufacturer. This makes it possible either to increase the production throughput of the cutting machine in corresponding manner, or else, while maintaining the same throughput, to reduce electrical power consumption.

In normal operation of cutting machines of the third type, problems sometimes arise during ejection of cut sheets. The cutting tool includes a system enabling the sheet to be held in place during cutting and then enabling it to be ejected while the tool-carrier plate is in the second position. That system operates by means of flexible hoses that operate like suction cups during the forward motion, and that operate like ejection hoses by blowing compressed air while the tool-carrier plate is in the second position, the cut sheet that has been ejected then being taken up by a removal system.

The difficulties encountered are manifested by offsets in time between ejection and taking up of cut sheets by the removal system. This causes cut sheets to be poorly placed on the takeup system and thus causes irregularities in subsequent stacking of said sheets.

Another object of the invention is to provide apparatus for cutting sheets that mitigate the above-specified drawback. In characteristic manner, the electronic control circuit is programmed so that the tool-carrier plate can be stopped in its second position for a determined length of time t which is entered as an operating parameter into the input means.

Thus, the operation of ejection by the action of compressed air in the hoses of the cutting tool, and the operation of a sheet being taken up by the removal system can both take place during the stop time t. It should be observed that such a stop is not possible with a conventional cutting machine.

The stop time is preferably of the order of a few hundredths of a second.

Another difficultly encountered in cutting machines of the third type lies in premature wear of certain members if the machine operates without sheets to be cut, i.e. if there is no sheet on the cutting tool while the tool-carrier plate is moving from its first position to its second position. Given that the cutting forces give rise to a small amount of deformation in the backing cylinder and in the tool-carrier plate, it is conventional to compensate for said deformation by causing the gap between the tool-carrier plate and the backing cylinder to be slightly smaller than the heights of the cutting blades. As a result, when the cutting machine is operated empty, the force that is exerted to cause said deformation is transmitted solely to the cutting blades, thereby causing them to wear. In the event of the backing cylinder being provided with a flexible covering, then it is the flexible covering that is subjected to premature wear under the action of the cutting blades.

Another object of the invention is to provide cutting apparatus that mitigates that drawback.

In characteristic manner, it comprises a sensor for sensing the presence of sheets, disposed in front of the backing cylinder and connected to the controlling electronic circuit; in addition the circuit is programmed to keep the tool-carrier plate in its first position in the event that the sensor does not detect a sheet.

Thus, by means of this particular disposition, the cutting tool does not come into contact with the backing cylinder when no sheet is detected in front of said cylinder by the position-identifying system.

Another difficulty may be encountered in cutting machines of the third type when the sheet to be cut that comes from the preceding station via launching means, is either early or late relative to its nominal position on entry into the cutting machine. Any such offset is reproduced in the positioning of the sheet on the cutting tool: cutting does not take place in the proper position relative to the sheet, and this can cause customers to reject products.

Another object of the invention is to provide apparatus that mitigates the above-mentioned drawbacks.

In characteristic manner, the apparatus includes a system for identifying the position of a predetermined element of the sheet, which system is situated upstream of the backing cylinder for the sheet and is fitted with an independent motor which is electronically servo-controlled and which, like the position identifying system, is connected to the controlling electronic circuit; in addition, the controlling circuit is programmed so that any difference that may be observed between the ideal position and the real position of the edge of the sheet, as detected by the position identifying system, is corrected by compensating variation in the drive of the motor fitted to the launch means.

Thus, because of this particular disposition, a sheet which is either early or late on leaving the preceding station has its feed speed reduced or accelerated in such a manner as to ensure that it is inserted onto the cutting machine very accurately under the required conditions. Automatic correction is thus obtained for positive or negative errors coming from the preceding station.

In a first variant, the predetermined element is the leading or trailing edge of the sheet; in which case the position-identifying system preferably consists in a position sensor.

In a second variant, the predetermined element is a given printed zone of the sheet; in which case the position-identifying system preferably consists in a camera suitable for detecting said printed zone.

Preferably, the vertical displacement means are adapted to displace the backing cylinder between a low position as adjusted as a function of the parameter $d_1$ or $d_2$, and corresponding to the cutting position, and a high position corresponding to the retracted position; in which case the controlling electronic circuit is programmed so that the backing cylinder is in its low position during the forward motion of the tool-carrier plate, from the first position to the second position, and is in the high position the rest of the time.

This disposition is preferred when the backing cylinder has a flexible material over its entire periphery, e.g. a material of the polyurethane type.

Another difficulty can arise when using cutting machines of the third type for cutting multi-cutout sheets. This term is used for sheets that are to be cut in such a manner that once cutting waste has been removed, independent sheet portions are left behind. These independent portions are referred to as "cutouts". The difficulty encountered consists in the lack of stability of stacks of cutouts at the outlet from the cutting machine. This is explained by the fact that they are of much smaller area than the size of the initial sheet.

Another object of the invention is to propose cutting apparatus that mitigates that drawback.

In characteristic manner, the controlling electronic circuit is programmed to operate periodically to maintain the backing cylinder in its high position during the forward motion of the tool-carrier plate, as it goes from the first position to the second position, at a frequency which is an operating parameter and which is entered via the input means of the electronic circuit.

By raising the backing cylinder, the sheet which is driven over the tool-carrier plate is not subjected to cutting and so it takes up a position on the already-formed stacks of different cutouts. By interposing an uncut sheet in this manner, a spacer effect is obtained between the various stacks of cutouts, thereby contributing to improved stability thereof.

Cutting machines of the third type are usually integrated in complete installations that include feeders and optionally that include printers. Under such circumstances, the drive mechanism of the cutting machine is merely a portion of the entire drive mechanism for the complete installation. As a result, it is not conceivable at present for such an installation to include a cutting machine other than one specially designed to operate with the remainder of the installation.

Another object of the invention is to propose cutting apparatus that mitigates the above-mentioned drawback.

In characteristic manner, the apparatus includes in a manner known from document FR 2 527 573, not only launching means for launching the sheet to position it on the cutting tool and to insert it beneath the backing cylinder, but also transfer means to bring said sheet from the preceding station up to the launch means. In characteristic manner, the transfer means are fitted with an independent motor that is subjected to electronic servo-control and that is connected to an electronic circuit. In addition, monitoring means are installed on the sheet displacement members of the preceding station, which monitoring means are connected to said electronic circuit. The electronic circuit is programmed so that firstly the speed of the transfer means is constantly equal to the speed of the sheet leaving the displacement members of the preceding station, and so that secondly the launching means are controlled as a function of said speed so that the sheet has a speed equal to the peripheral linear speed of the backing cylinder when it reaches the cutting tool.

Thus, the improved cutting machine of the invention can be disposed in an existing installation. The cutting machine receives sheets at the linear speed as imposed by the preceding station without that being harmful to the desired throughput of the cutting machine.

Finally, another object of the invention is to propose cutting apparatus in which the covering of the backing cylinder can be changed automatically without manual intervention.

In characteristic manner the backing cylinder is fitted simultaneously with two types of covering: the first support means suitable for receiving the covering constituting the backing surface during cutting is constituted by a curved metal sheet extending over a first angular fraction at a distance R from the axis of rotation of the cylinder; the second support means suitable for receiving the standby covering consists in a curved metal sheet disposed over a second angular fraction at a distance r from the axis of rotation of the cylinder; the apparatus includes displacement means suitable for radially displacing the two coverings relative to their respective support means, and for displacing them angularly so as to interchange them.

The coverings are preferably secured at each end to the chassis via a plurality of rods terminated by wheels; the end members of the chassis carry a concentric rail forming a track for said wheels; the radial displacement means consist in actuators whose rods are terminated by sliders each comprising two radially-superposed short lengths of said concentric rail, the wheels being received in the radially inner lengths. Said actuators are actuateable to be moved between a first position in which their rods are retracted, the coverings are pressed against their respective supports and the short lengths containing the wheels are disposed radially inside the track while the outer short lengths are in alignment with the longer arcs of the rail mounted on the end members of the chassis; and a second position where the rods are extended and the coverings are lifted off their support sheets and the short lengths of rail containing the wheels are put into alignment with the longer arcs of rail mounted on the end members of the chassis. In this way, the wheels can move angularly around the track while the coverings are no longer pressed against the support sheet. Because of this double displacement, it is possible to bring the standby second covering from the second support means so as to cause it to take the place of the first covering on the first support means.

The angular displacement means may be constituted by an independent motor with electronic servo-control for rotating the backing cylinder, and by means for temporarily locking the coverings. To change covering, once the supporting sheets have been displaced radially, it suffices to lock the coverings in position in such a manner as to keep them fixed relative to the chassis, and then to rotate the cylinder, e.g. through 180°, the wheels revolving in the running track.

The above-mentioned independent motor, the locking means, and the actuators are preferably all connected to the controlling electronic circuit which is programmed so as to cause the rods of the actuators to be extended initially, then to cause the coverings to be locked into place, then to cause the cylinder to rotate, then to unlock the coverings, and finally to retract the rods into the actuators.

BEEF DESCRIPTION OF THE DRAWINGS

The present invention will be better understood on reading the following description of an embodiment of an improved cutting machine that operates automatically, and that is shown in the accompanying drawings, in which.

MORE DETAILED DESCRIPTION

Figure 1:
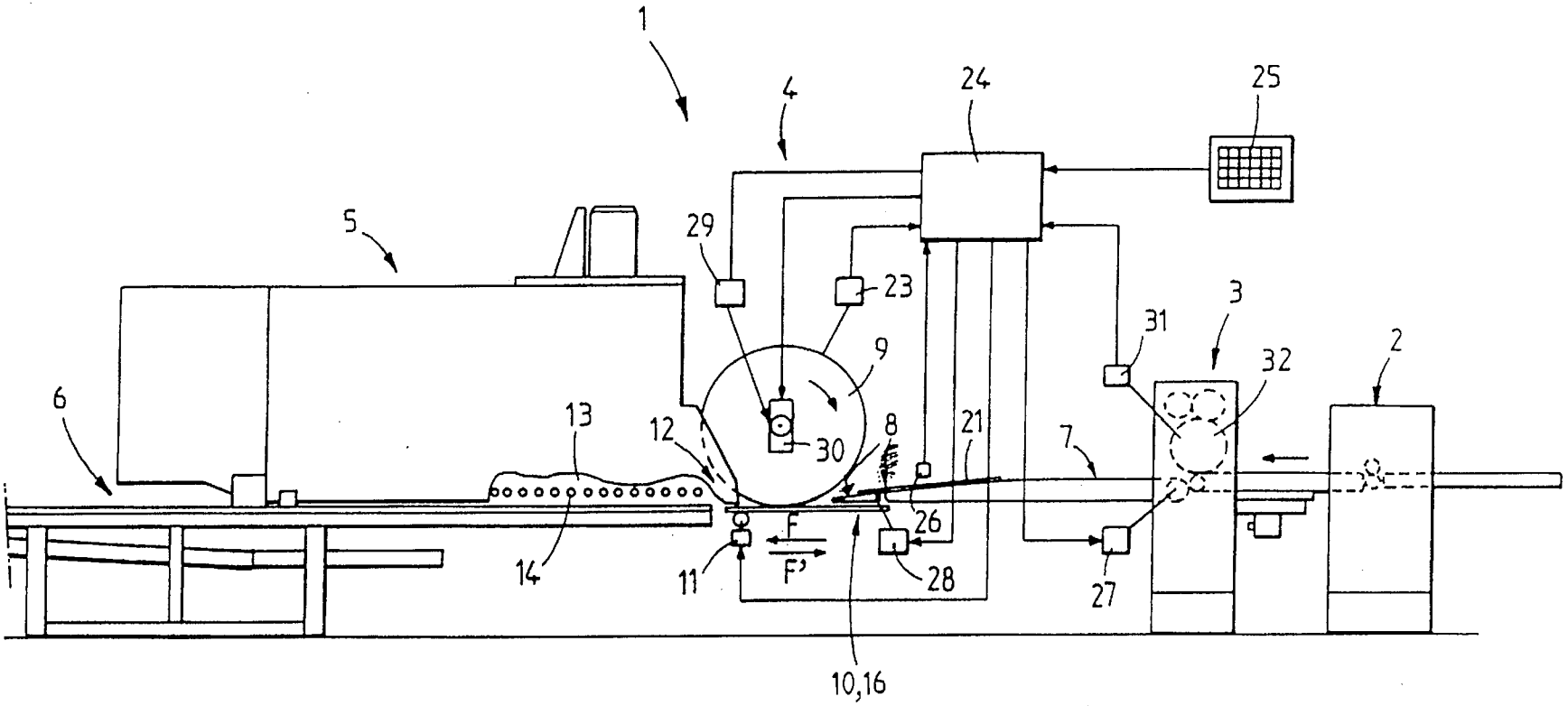
FIG. 1 is a diagrammatic view of an installation including the improved cutting machine.

The installation 1 shown in FIG. 1 is an installation for printing and cutting sheets of corrugated cardboard one by one. The installation comprises, starting from its upstream end and going downstream in the sheet displacement direction: firstly a feeder 2, then a printer 3, a cutter 4, a belt 5 for removing cutting wastes, and finally a stacking and reception station 6.

The cutting machine includes a transfer belt 7 and a launching belt 8, a backing cylinder 9, and a tool-carrier plate 10 which is driven with reciprocating forward-and-return motion as shown by arrow F for forward motion and by arrow F' for return motion.

The tool-carrier plate 10 includes longitudinally extending racks (not shown) and its reciprocating motion is obtained by rotating toothed wheels that mesh with said racks. Said toothed wheels are driven by at least one electronically servo-controlled motor 11 of the brushless type.

The waste removal belt 5 includes a suction channel 12 at the immediate outlet from the cylinder 9 and a cutout conveyor 13 which is placed beyond the suction channel 12 and which is constituted by rollers 14 extending transversely relative to the displacement direction of a sheet and which are spaced apart from one another, leaving empty gaps. Within the belt 5, there are provided suction means of a first circuit that opens out to the suction channel 12, said first circuit corresponding to removal of cutting waste 15, and a second suction circuit opening out into the cutout conveyor 13. The rollers 14 are rotated by means that are not shown. Such rotation (as explained in greater detail below) serves to remove cutouts to the reception and stacking station 6.

Figure 2A:
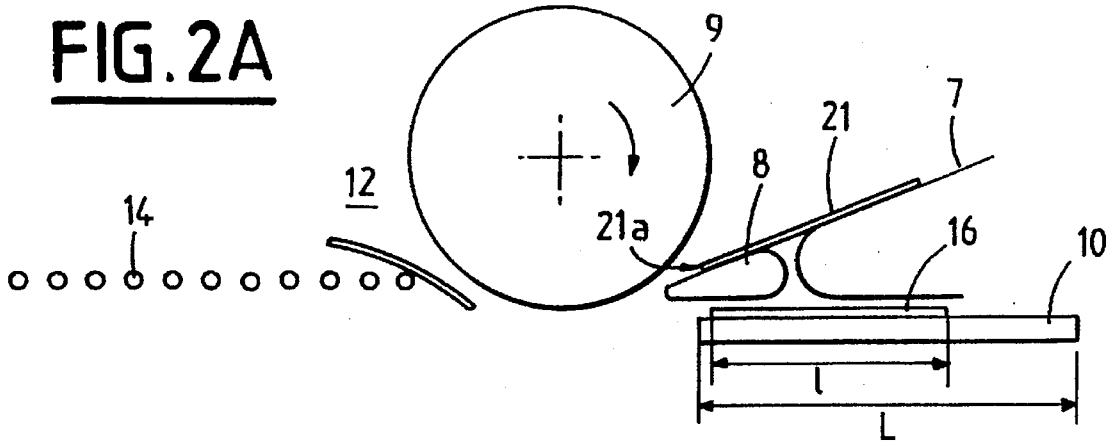
FIGS. 2A to 2D show various steps in the operation of the cutting machine as shown in part in FIG. 1, with FIG. 2E showing the step that corresponds to FIG. 2D, but in a conventional cutting machine.
Figure 2B:
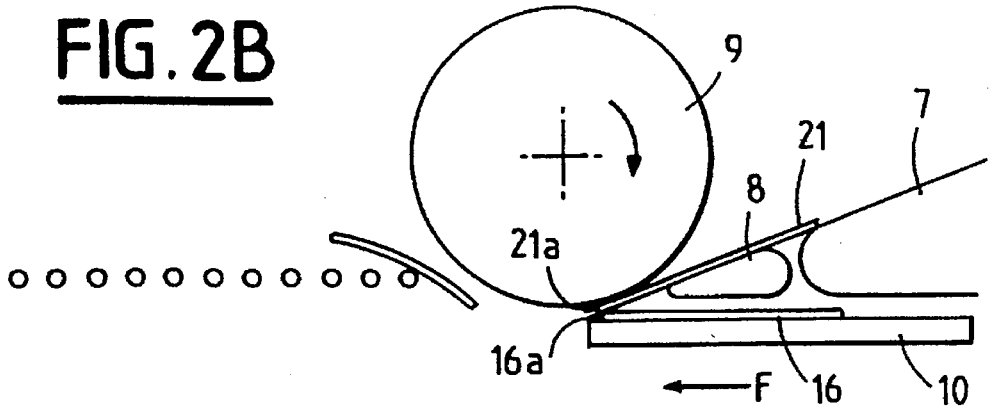
Figure 2C:
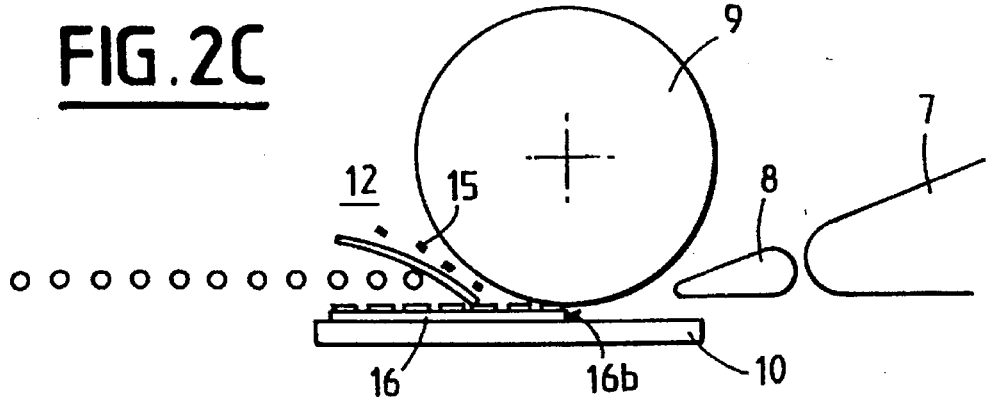
Figure 2D:
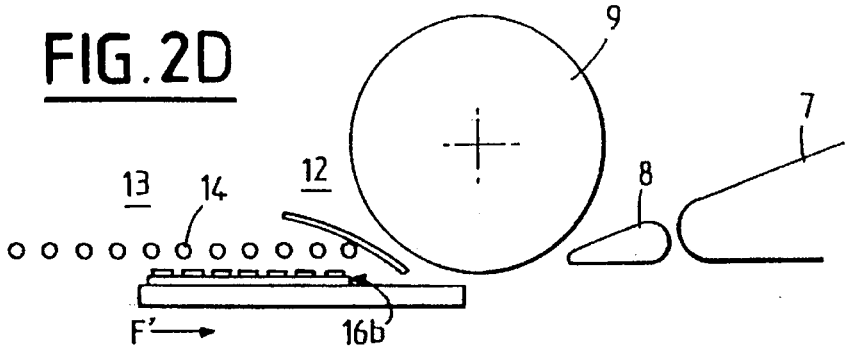

FIGS. 2A to 2D show the various steps in the operation of the cutting machine 4 when the tool-carrier plate 10 goes from its front first position (FIG. 2A) to its rear second position (FIG. 2D). A cutting tool 16 is secured to the tool-carrier plate 10. Cutting blades or edges 17 are mounted vertically on said cutting tool 16 in a configuration that matches the outline to be cut. The cutting tool 16 also includes suction hoses 18 and ejection bellows 19 distributed in each of the zones that corresponds to a cutout 20. The term "cutout" is used to designate each of those sheet portions that result from an initial sheet being cut.

When the tool-carrier plate 10 is in its first position, upstream of the cutting machine, it is situated beneath the transfer belt 7 and beneath the launching belt 8, as is the cutting tool 16. A sheet 21 to be cut is fed from the preceding station, e.g. the printer 3 in the example shown in FIG. 1. This sheet 21 overlies the transfer belt 7 and the launching belt 8. It extends obliquely towards the bottom surface of the cylinder 9.

In the step shown in FIG. 2B, the tool-carrier plate 10 has begun its forward displacement as shown by arrow F, the sheet 21 itself being displaced by drive from the launching belt 8, and the cylinder 9 has itself rotated through a certain angle. All of these displacements are synchronized so that the leading edge 21*a* of the sheet 21 comes into accurate engagement with the front edge 16*a* of the cutting tool 16 when said sheet comes into contact with the outside surface of the cylinder 9.

This first step between the first position as shown in FIG. 2A and the intermediate position as shown in FIG. 2B constitutes the launching step of the tool-carrier plate 10. On reaching the position shown in FIG. 2B, the tool-carrier plate 10 must have acquired a speed $V_1$ that is equal to the linear speed of the outer surface of the cylinder 9 which comes into contact with the sheet 21. The sheet must also have acquired the same displacement speed $V_1$ under drive from the launching belt 8.

The tool-carrier plate 10 must retain the same displacement speed $V_1$ until it reaches the position shown in FIG. 2C, i.e. the position in which the trailing edge 16*b* of the cutting tool 16 loses contact with the outer surface of the cylinder 9.

The last step of the forward-and-return motion of the tool-carrier plate 10 is terminated by the second position shown in FIG. 2D in which the cutting tool 16 is placed beneath the rollers 14 of the finished sheet conveyor 13 after having passed beneath the suction channel 12. This stage corresponds to the tool-carrier plate 10 being decelerated until it comes to rest, and prior to its return motion in the direction on arrow F'. The height of the cutting tool 16 over the cutting blades is equal to the spacing between the outer surface of the backing cylinder 9 and the tool-carrier plate 10 such that the sheet 21 penetrates progressively over the cutting blades as it passes beneath the axis of rotation 22 of the cylinder 9.

The passage of the cutting tool 16 that supports the cut sheet 21 beneath the suction channel 12 enables cutting waste 15 to be removed via the channel 12. The cut sheet that is on the cutting tool 16 when the tool-carrier plate 10 is in its second position as shown in FIG. 2D is ejected from said cutting tool 16 by a blast of compressed air passing through the ejection bellows 19 while the suction that used to be applied through the hoses 18 is interrupted. This ejection combined with the suction that is implemented in the conveyor 13 enables the cutout 20 to be pressed against the rollers 14. The rollers are caused to rotate so as to remove the cutouts 20 towards the reception and stacking station 6.

The tool-carrier plate 10 is driven in its reciprocating motion by at least one independent motor 11 capable of rotating in either direction and under electronic servo-control. In addition, the cutting machine 4 includes monitoring means 23 for monitoring rotation of the backing cylinder 9. The motor 11 is of the brushless type and the monitoring means 23 are connected to an electronic control circuit 24 which includes input means 25, e.g. in the form of a keyboard.

The monitoring means 23 may be constituted, for example, by an encoding disk mounted on the shaft of the cylinder 9. Before starting operation, the operator enters operating parameters via the input means. These parameters include at least the length 1 of the cutting tool 16, which length corresponds to the format of the sheet to be cut.

The controlling electronic circuit 24 is programmed so that the following condition is satisfied. The linear speed of the tool-carrier plate must constantly be equal to the peripheral linear speed of the backing cylinder 9 so long as the cutting tool 16 is in contact with the backing cylinder 9. This condition can be achieved by tracking instantaneous rotation of the backing cylinder 9 using the monitoring means 23 and by knowing the length 1 of the cutting tool.

In addition, the controlling electronic circuit 24 is programmed so as to cause the amplitude of the forward-and-return motion of the tool-carrier plate 10 to vary as a function of the length 1 of the cutting tool 16. The greater the difference between the length 1 of the sheet to be cut and the maximum cutting length L possible using the machine, the smaller said amplitude compared with the maximum amplitude for which the machine has been designed.

In conventional cutting machines, all of the moving members, in particular the backing cylinder, the tool-carrier plate, the transfer belt, and the launching belt are driven from a single drive member via mechanisms such as cams, gear wheels, and racks. The stroke of the tool-carrier plate is designed for the maximum format of sheet to be cut. Thus, as shown in FIG. 2E, the second position of the tool-carrier plate is achieved only once the trailing edge **10*b* of the tool-carrier plate 10 comes beneath the conveyor 13**.

Figure 2E:
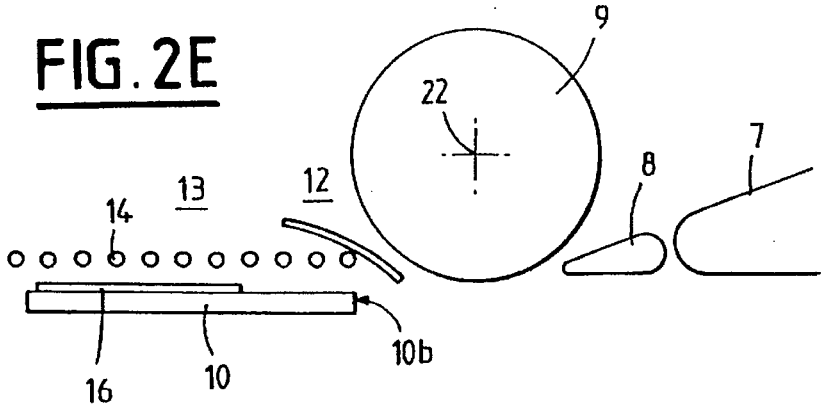
Figure 3:
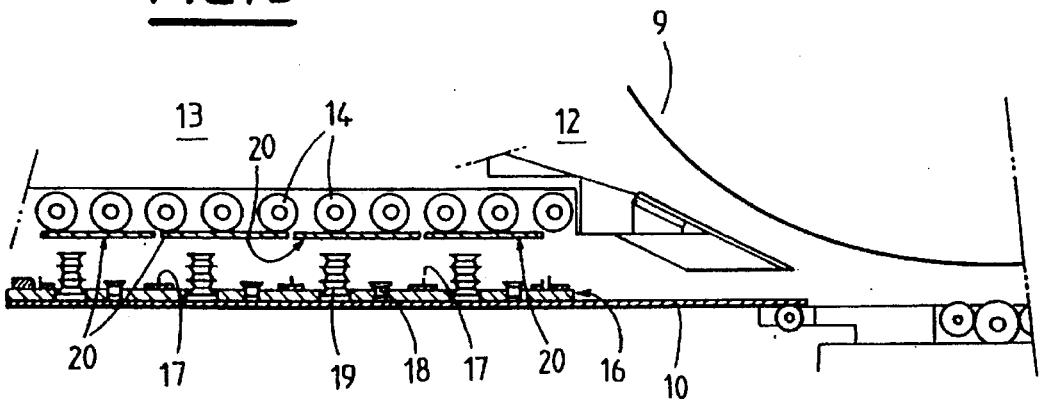
FIG. 3 is a fragmentary view of the cutting machine when the tool-carrier plate is in its position for ejection of the cut sheet.

A comparison between FIGS. 2D and 2E shows clearly how the amplitude of the forward-and-return motion of the tool-carrier plate 10 can be reduced as a function of the length 1 of the cutting tool 16.

By reducing the amplitude of motion in this way, it is possible either to maintain the same production throughput while reducing power consumption or else, on the contrary, to increase production throughput.

The controlling electronic circuit 24 is preferably programmed so that the drive motor 11 drives the tool-carrier plate 10 during the return motion thereof in application of a simple relationship comprising acceleration that is immediately followed by deceleration, such that the duration of the return motion is shorter than that of the forward motion. It is thus possible to increase production throughput without changing cutting conditions during the forward motion of the tool-carrier plate 10.

The backing cylinder 9 is designed to work either with a steel backing surface or else with a backing surface made of a flexible material, in particular polyurethane. To do this, said backing cylinder 9 comprises a chassis which includes support means suitable for receiving as the backing surface one or other of the coverings, either the covering made of steel or else the covering made of flexible material. With a steel covering, its thickness $d_1$ will be less than the thickness $d_2$ of the covering of flexible material. The cutting machine 4 includes vertical displacement means 30 which are connected to the controlling electronic circuit 24. The operator enters into the input means 25 an indication concerning which one of the two coverings is to be used, or merely the corresponding thickness $d_1$ or $d_2$.

It will be understood that in order to ensure the cutting operation takes place under good conditions, it is necessary to adjust the position of the outside surface of the backing cylinder 9 accurately relative to the cutting tool 16. This is the adjustment that is performed automatically by the controlling electronic circuit 24 which controls the vertical displacement means 30 for the backing cylinder 9 as a function of the value of the parameter entered by the operator. The speed of rotation of the backing cylinder 9 and its radius to the backing surface determine the peripheral linear speed of the cylinder.

The controlling electronic circuit takes account of these parameters which are a function of the thickness $d_1$ or $d_2$ to ensure that the tool-carrier plate 10 is launched by the motor 11 and that the sheet 21 is launched by the launching means 8 in such a manner as to ensure that their linear speed is equal to that of the backing cylinder 9 while also remaining in synchronization when the assembly is in the position shown in FIG. 2B.

Because of this special command, it is possible to place either of the coverings on the chassis and the support means of the cylinder without any special modification of the adjustments of the cutting machine 4.

The controlling electronic circuit 24 is preferably programmed so that provision is made for the tool-carrier plate 10 to be stopped once it reaches the second position shown in FIG. 2D. It is during this stop time that firstly suction through the hoses 18 is switched off and secondly compressed air is applied to the ejection bellows 19. Since this takes place when the cutting tool 16 is stationary between the rollers 14 of the cutout conveyor 13, accurate ejection of said cutouts 20 is guaranteed and it is also guaranteed that they are taken up by the conveyor 13. Advantageously, the stop time t which is entered as an operating parameter by the operator using the input means 25 is selected so be of the order of a few hundredths of a second.

Naturally, this stop time (which does not exist in conventional cutting machines) increases the time required for a forward-and-return cycle of the tool-carrier plate 10. However, because the stroke is reduced as a function of format, this increase is quite harmless, particularly since it guarantees that cutouts are accurately taken up and therefore that they are subsequently stacked correctly.

The cutting machine 4 also includes a sensor 26 for sensing the presence of sheets. The sensor is placed upstream from the backing cylinder 9, above the transfer box 7. This sensor 26 is connected to the controlling electronic circuit 24. In addition the electronic circuit is programmed to keep the tool-carrier plate 10 in its first position as shown in FIG. 2A in the event of the sensor 26 failing to detect the presence of a sheet. Thus, when there is no sheet or when there is an interruption in supply from the printer 3, the tool-carrier plate 10 remains in its first position and does not perform any forward-and-return motion. This prevents the cutting machine operating empty, where such operation gives rise to premature wear of the cutting blades or perhaps of the flexible material constituting the outside surface of the cylinder 9.

The same sensor 26 may also be implemented as means for detecting the leading edge **21*a* of the sheet 21 to be cut. In that case the transfer belt 7 and the launching belt 8 are driven by respective motors 27 and 28 both of the brushless type and both under electronic servo-control. The two motors 27 and 28 are also connected to the controlling electronic circuit 24**.

To synchronize displacement of the sheet 21, of the transfer belt 7, of the launching belt 8, of the cylinder 9, and of the tool-carrier 10, as illustrated in FIG. 2B, it is important for the leading edge **21*a* of the sheet 21 to come beneath the sensor 26 at the precise instant in the operating cycle. If the controlling electronic circuit 24 observes on the basis of information transmitted thereto by the sensor 26 that there is a positive or negative error between the ideal position for the leading edge 21*a* and the real position of said edge, then the controlling electronic circuit 24 applies compensating control to the motor 28 driving the launching belt 8 so as to correct such variation and ensure that the leading edge 21*a* is accurately synchronous with the tool-carrier plate 10**, as shown in the configuration of FIG. 2B.

This makes it possible to guarantee that the sheet 21 is accurately positioned on the tool-carrier plate 10 and thus that cuts are made in accurately repeatable positions.

During return motion of the tool-carrier plate 10 in the direction of arrow F', it is important to ensure that the cutting blades 17 do not come into contact with the outside surface of the backing cylinder 9 since otherwise there would be premature wear of the cutting blades, particularly when the outside surface of the cylinder is made of steel, or else there would be premature wear of the outside surface of the backing cylinder 9 when that surface is made of a flexible material.

To avoid such contact, the vertical displacement means 30 for moving the backing cylinder 9 enable the cylinder 9 to be raised from a low position corresponding to its cutting position up to a high position that corresponds to a retracted position in which the outside surface of the cylinder 9 is at a distance from the cutting tool 16 during the return motion of the tool-carrier plate 10.

The controlling electronic circuit 24 is programmed so that the backing cylinder 9 is in its low position during the forward motion of the tool-carrier plate 10, and in its high position the rest of the time. In this embodiment of the cutting machine 4 in which the backing cylinder 9 is fitted with vertical displacement means 30, the controlling electronic circuit 24 is preferably programmed to control said vertical displacement means 30 in periodic manner so that the backing cylinder 9 remains in its retracted high position from time to time during the forward motion of the tool-carrier plate 10. This command and the frequency with which it needs to be made, e.g. once every fifty sheets, are operating parameters that are entered by the operator via the input means 25 of the controlling electronic circuit 24.

The effect of this command is to cause the corresponding sheet as fed from the transfer belt 7 and the launching belt 8 to be placed on the cutting tool 16 and to pass from the first position to the second position without being pressed against the cutting blades by the backing cylinder 9. As a result, the sheet as ejected from the cutting tool 16 and taken up by the conveyor 13 is a sheet that has not been cut. This technique is particularly advantageous when sheets are cut into multiple cutouts, i.e. when a plurality of separate portions are all cut from a single sheet. The uncut sheets allowed through the machine at regular intervals serve to stabilize the various stacks of separated cutouts 20, thereby acting as spacer members.

The members for displacing the sheet 21 from the station preceding the cutting machine 4 are provided with monitoring means 31 which are connected to the controlling electronic circuit 24. The transfer belt 7 and the launching belt 8 are driven by electronically servo-controlled brushless motors given respective references 27 and 28 which are themselves connected to the controlling electronic circuit 24. The circuit is programmed so that the speed of a sheet leaving the preceding station and detected by the monitoring means 31 is maintained constantly equal to the speed of the sheet on the transfer belt 7. In addition, the motor 28 driving the launching belt 8 is controlled as a function of the above-specified speed so that the sheet is launched towards the backing cylinder g in such a manner that on reaching the position shown in FIG. 2B, its speed is equal to the peripheral linear speed of the backing cylinder 9.

In the example shown in FIG. 1, the preceding station is a printer 3, and the monitoring means 31 are constituted, for example, by a coding wheel mounted on the axis of rotation of the plate-carrying cylinder 32.

This particular disposition makes it possible to cause operation of the cutting machine 4 to be entirely independent of the speed at which sheets 21 are fed from the preceding station.

Under circumstances where said speed is unlikely to vary over time, it may suffice to omit the monitoring means 31 and to input an operating parameter via the input means 25 that corresponds to information concerning the speed at which a sheet is moving on leaving the preceding station. Under such circumstances, the speed of the transfer belt 7 and the speed of the launching belt 8 are automatically set as a function of the value of said parameter.

In the example shown in FIGS. 4A–4D to 6, the apparatus of the invention makes it possible automatically and without manual intervention to change the covering. To do this, the backing cylinder 33 is permanently fitted with two coverings 34 and 35, one of which is a steel covering 34 of thickness $d_1$ while the other one is a covering of flexible material 35 of thickness $d_2$ that is greater than $d_1$.

Figure 4A:
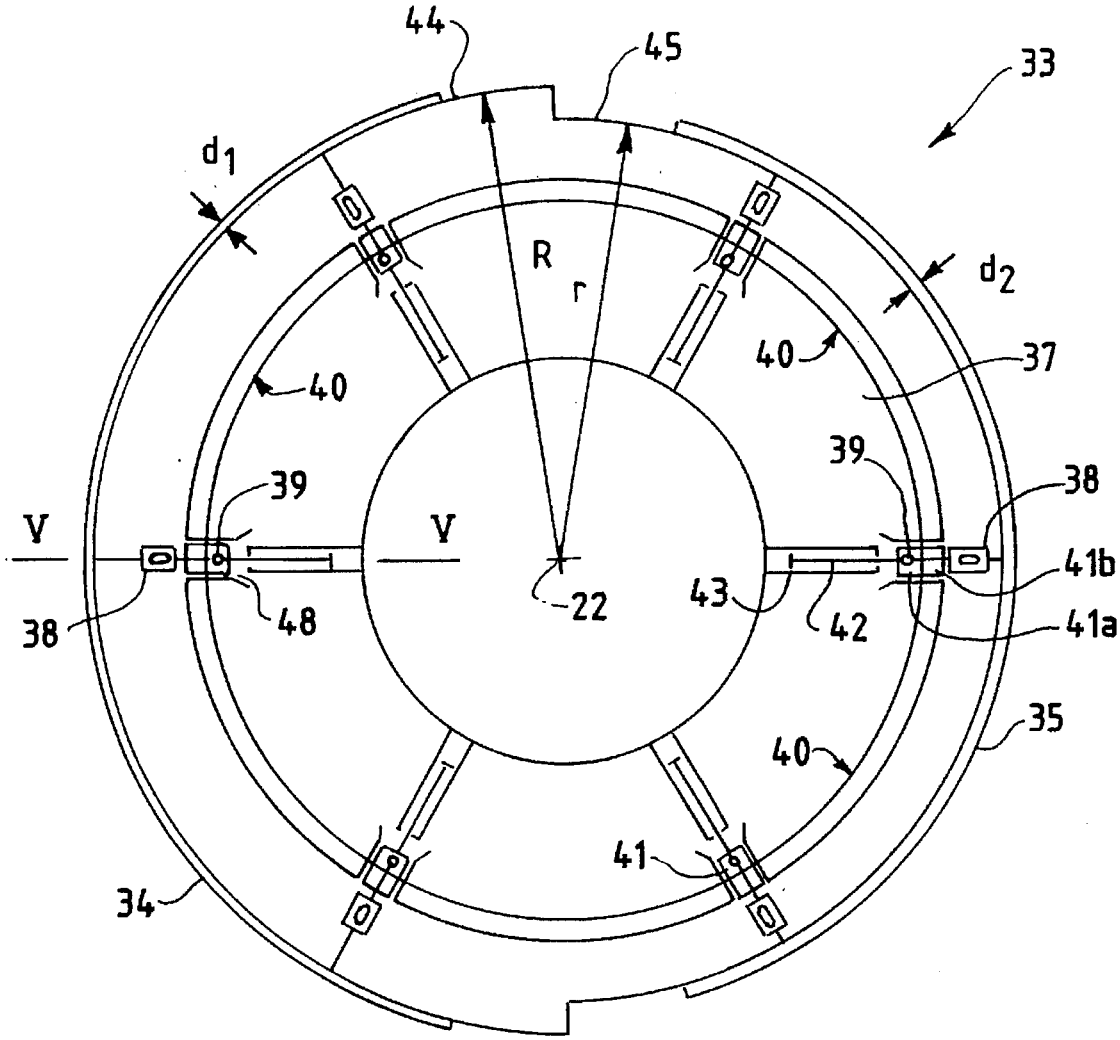
FIGS. 4A–4D are diagrammatic side views of a backing cylinder having two interchangeable coverings.

As can be seen in FIG. 4A, the backing cylinder 33 has two angularly distinct halves of respective radii R and r, where r is less than R. The first covering 34 acting as the backing surface is pressed against the first angular half of radius R, while the second covering 35 that is in a standby position is pressed against the second angular half. During a cutting operation, the backing cylinder 33 is rotated continuously, but only the first covering 34 is used in co-operation with the tool-carrier plate.

The coverings 34 and 35 are secured to the chassis 37 of the backing cylinder 33 via their end edges 36. More precisely, the edges 36 are fixed to a plurality of rods 38 whose free ends are folded in towards said chassis 37 and are terminated by wheels 39. The wheels 39 are designed to be received in a channel-section rail disposed on the chassis 37 concentrically about the axis of rotation 22 of the cylinder 33, said rail forming a running path.

Figure 5:
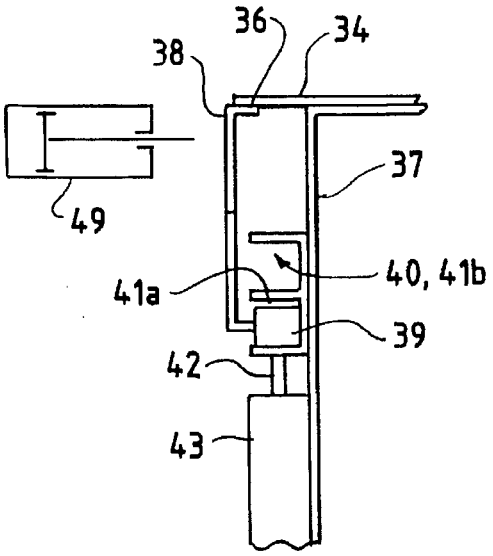
FIG. 5 is a fragmentary view of the FIG. 4 cylinder in section on line 5—5.
Figure 6:
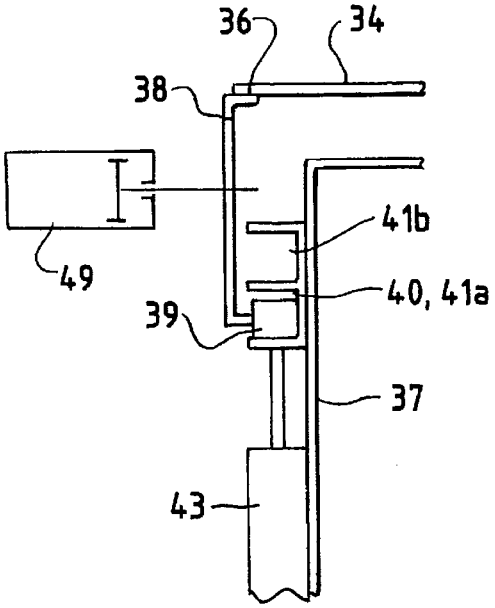
FIG. 6 is similar to FIG. 5, showing the backing cylinder but with the covering being at a distance from its support sheet.

The rail has generally arcuate portions or "arcs" 40 that are fixed to the chassis 37 and sliders 41 that are fixed to the ends of rods 42 of actuators 43 that are themselves fixed to the chassis 37. More precisely, each rod 42 of an actuator 43 is terminated by two radially superposed short lengths **41*a* and 41 *b* of concentric track. The wheels 39 are received in the radially inner short lengths 41*a*. The short lengths 41*a* are designed to fit slidably in slots 48 between the arcs 40 when the rods 42 of the actuators 43 are in their retracted positions, as illustrated in FIG. 5. The short lengths 41*b* are designed to come exactly into alignment with the arcs 40 when the rods 42 of the actuators 43 are in the extended position, as shown in FIG. 6. The apparatus of the invention also includes means 49 for locking the coverings 34 and 35 in position when they are in the high position, i.e. when the rods 42 of the actuators 43 are extended, as shown in FIG. 6. In addition, the rotary shaft 22 of the cylinder 33 is driven by an independent motor that is electronically servo-controlled, and in particular a brushless motor, which motor is connected to the controlling electronic circuit, as are the actuators 43. The coverings are changed over by performing the following steps under automatic control of the electronic circuit whenever a covering changeover operating parameter is input thereto. The disposition of the various members of the cylinder 33 is normally as shown in FIG. 4A, with the rods 42 of the actuators 43 being retracted and the short lengths 41*a* containing the wheels 39 slid into a low position, i.e. retracted relative to the running track, the coverings 34 and 35 being pressed against semi-cylindrical metal sheets 44 and 45 acting as support sheets for the coverings 34 and 35. It should be observed that the cylinder 33 may include an internal suction system for pressing the coverings 34 and 35 against the said sheets 44 and 45**, as described in document FR 82 09702.

Figure 4B:
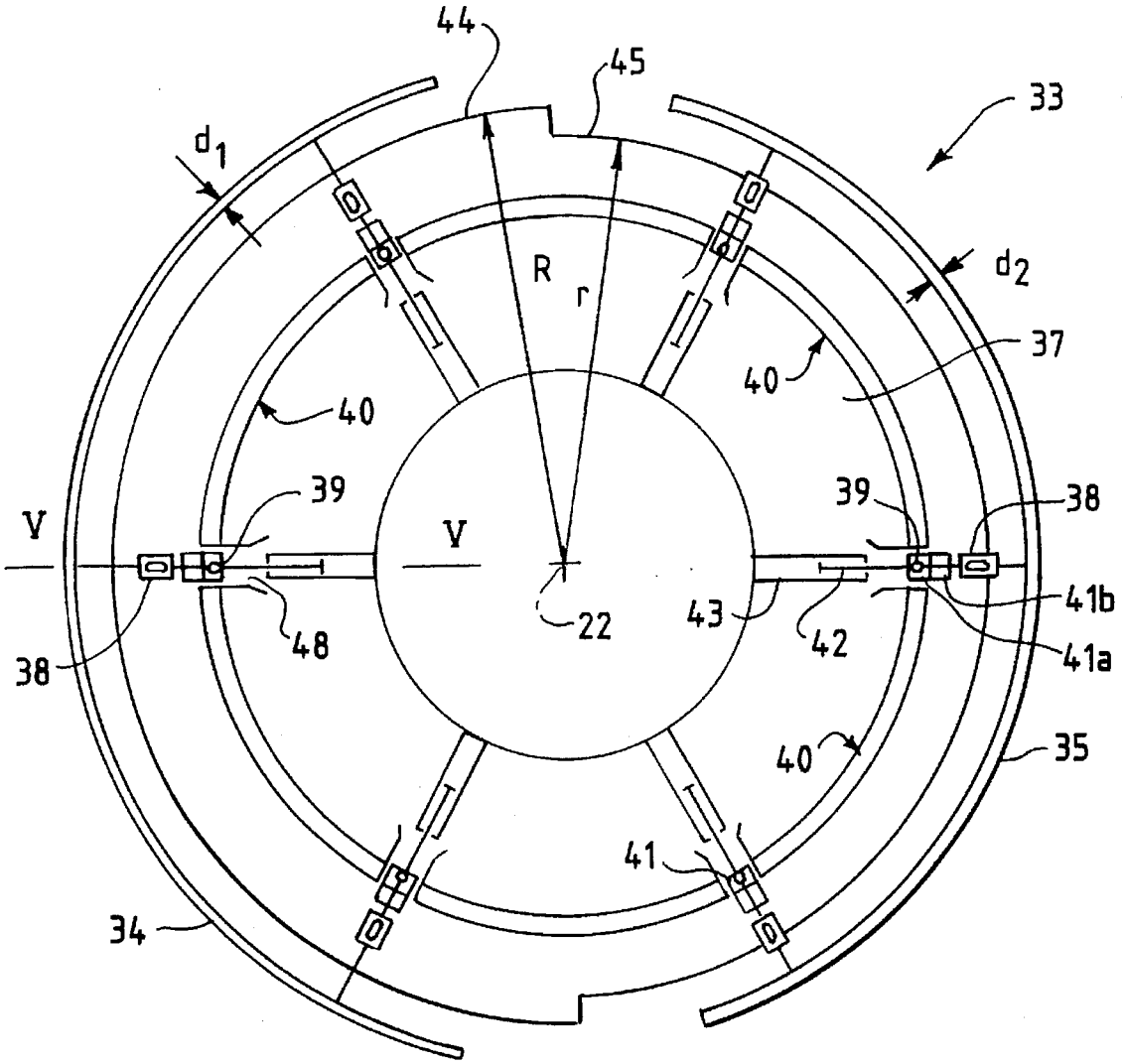

The first changeover step consists in actuating the actuators 43 so as to extend their rods 42 and position the short lengths 41*a* containing the wheels 39 in alignment with the arcs 40 (FIG. 4B) so as to constitute one continuous running track for the wheels 39. Simultaneously, the coverings 34 and 35 are moved away from the curved metal sheets 44 and 45, as shown in FIG. 4B and FIG. 6. Naturally the suction system is switched off at this time.

The second step consists in actuating the means for locking the coverings 34 and 35 so as to hold the coverings in a fixed annular position relative to the rotary shaft 22 as shown in FIG. 6.

Figure 4C:
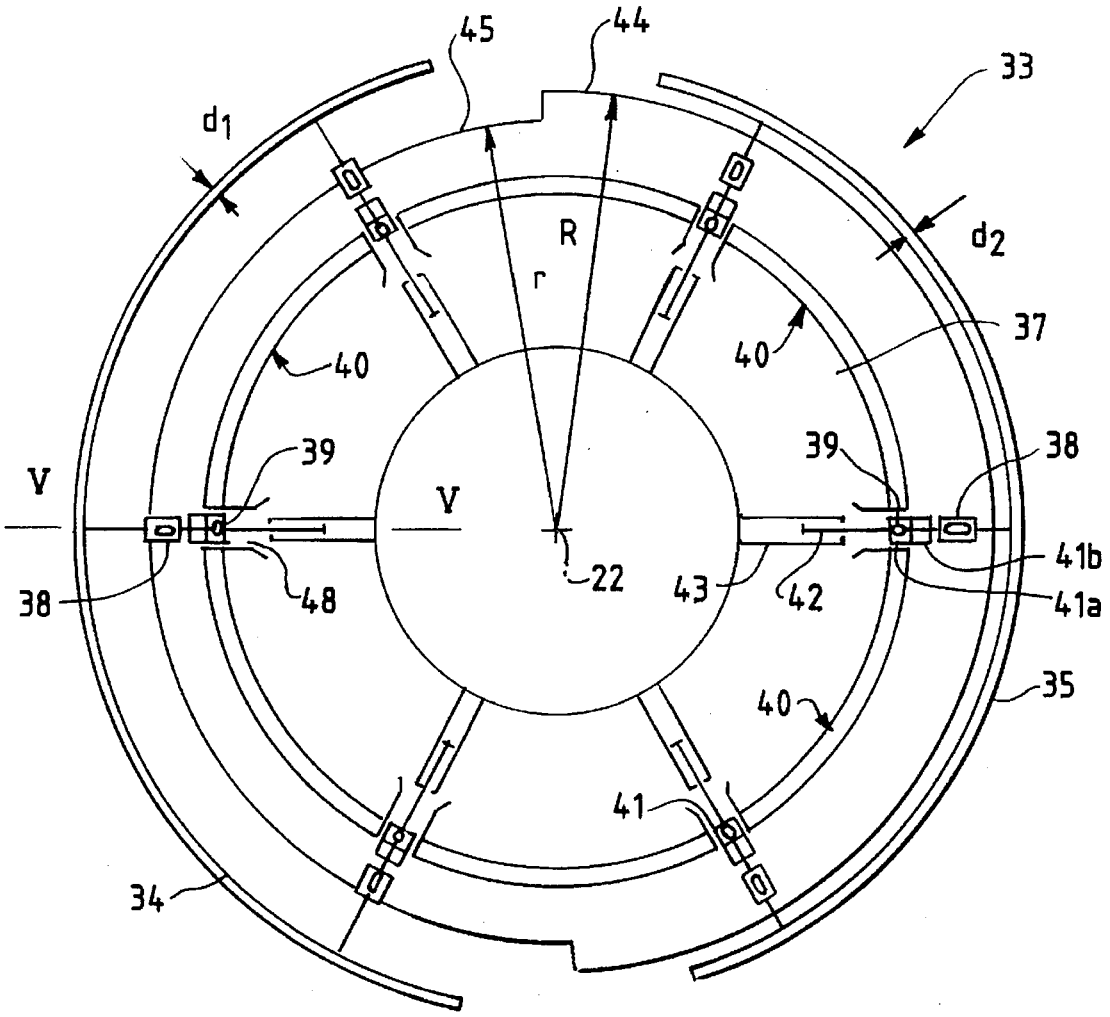

The third step consists in operating the independent motor to cause the chassis 37 of the cylinder 33 to rotate through 180° (FIG. 4C). During this rotation, the wheels 39 rotate as they run along the running track, thus enabling the coverings 34 and 35 to remain in position in spite of the chassis 37 rotating.

Figure 4D:
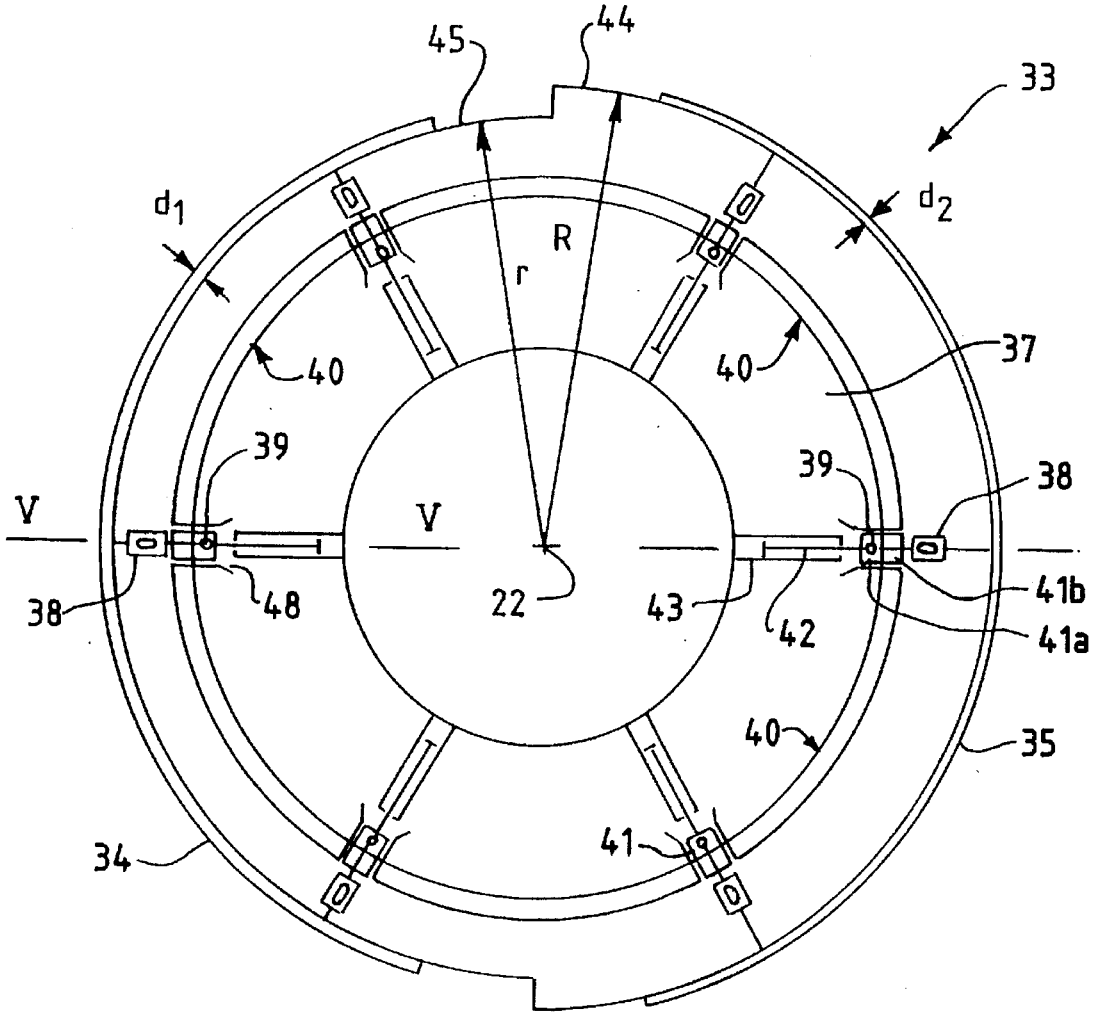

The fourth step consists in unlocking the coverings 34 and 35, and the fifth step consists in actuating the actuators so as to retract the rods 42, as shown in FIGS. 4D and 5.

During rotation of the chassis 37 through 180° , the covering 34 is brought over the angular portion of radius r, while the covering 35 is placed over the angular portion of radius R. After the rods 42 of the actuators 43 have been retracted, the coverings 34 and 35 are pressed against the corresponding support sheets 45 and 44. The covering 35 is then ready to act as the backing surface for cutting purposes, while the covering 34 is in the standby position.

Advantage can be taken of this possibility of moving the coverings 34 and 35 relative to each other whenever it is necessary to perform fine adjustment of the positions of the coverings 34, 35 in order to compensate for possible surface irregularities, adjustment being performed by inserting small wedges or "shims" between the supporting sheet 44 and the covering 34. To do this, it suffices for the electronic circuit to be programmed to control only those actuators that correspond to a given angular portion together with only those locking means that correspond to a given covering so as to make the outside surface of the supporting sheet 44 without any covering 34 accessible to the operator, after appropriate rotation of the chassis 37.

We claim:

1. Apparatus for cutting semi-rigid sheets one by one, comprising:

a) a cutting tool, a tool-carrier plate and a backing cylinder, the cutting tool fixed on the tool-carrier plate, the tool-carrier plate being driven with forward-and-return reciprocating motion between a first position where the cutting tool is situated upstream from the backing cylinder and a second position where the cutting tool is situated downstream from the backing cylinder, and launching means for feeding the sheet, the sheet being inserted by the launching means onto the cutting tool when the tool-carrier plate has left the first position, the sheet being cut as it passes under the backing cylinder and then being removed from the cutting tool when the tool-carrier plate is in its second position, wherein the backing cylinder comprises a chassis and support means suitable for receiving selectively, as a backing surface, a steel covering of thickness $d_1$ or a covering of flexible material of thickness $d_2$;

b) vertical displacement means for displacing the backing cylinder between two positions adjusted for receiving a selected one of the coverings for cutting purposes, the first corresponding to the thickness $d_1$, and the second corresponding to the thickness $d_2$;

c) at least one first independent motor having electronic servo-control and rotatable in either direction, driving the tool-carrier plate in reciprocating motion, and a second independent motor having electronic servo-control driving the launching means; and d) monitoring means for monitoring rotation of the backing cylinder;

wherein said first and second motors, the monitoring means, and the vertical displacement means for the backing cylinder are connected to a controlling electronic circuit that has input means for receiving operating parameters including at least the thickness $d_1$ or $d_2$ of the covering; and wherein said controlling electronic circuit is programmed to control the vertical displacement means for displacing the backing cylinder as a function of the thickness parameter, and for controlling the first and second motors so that the linear speed of the launching means and that of the tool-carrier plate are equal to the peripheral linear speed of the backing cylinder at the moment when the cutting tool presents the sheet under the backing cylinder, and so that the linear speed of the tool-carrier plate is equal to the peripheral linear speed of the backing cylinder so long as the cutting tool is in contact with said backing cylinder.

2. Apparatus according to claim 1, wherein the length l of the cutting tool is one of the operating parameters, and the electronic circuit is programmed so that the amplitude of the reciprocating motion of the tool-carrier plate is a function of the parameter l.

3. Apparatus according to claim 1, wherein said controlling electronic circuit is programmed so that the tool-carrier plate is stopped in its second position for a determined length of time t which is entered as an operating parameter via the input means.

4. Apparatus according to claim 1, including a sensor for sensing the presence of sheets, the sensor being located upstream from the backing cylinder and being connected to the controlling electronic circuit; and wherein the electronic circuit is programmed to keep the tool-carrier plate in its first position whenever said sensor does not detect a sheet.

5. Apparatus according to claim 1, including a system situated upstream from the backing cylinder and connected to the controlling electronic circuit, said system having a sensor for identifying a predetermined element on the sheet, and wherein said controlling electronic circuit is programmed so that any difference observed between an ideal position and an actual position of the edge of the sheet as detected by the sensor is corrected by a compensating variation in the drive of the second motor for the launching means.

6. Apparatus according to claim 5, wherein the predetermined element is the leading or trailing edge of the sheet, and the sensor system is a position sensor.

7. Apparatus according to claim 5, wherein the predetermined element is a predetermined printed zone of the sheet.

8. Apparatus according to claim 1, wherein the vertical displacement means for the backing cylinder are suitable for moving the backing cylinder between a cutting position and a retracted position, and wherein the controlling electronic circuit is programmed so that the backing cylinder is in the cutting position during the forward motion of the cutting tool, as the cutting tool goes from its first to its second position, and is in the retracted position the rest of the time.

9. Apparatus according to claim 1, wherein the vertical displacement means for the backing cylinder are suitable for moving the backing cylinder between a cutting position and a retracted position, and wherein the controlling electronic circuit is programmed to maintain the backing cylinder periodically in the retracted position while the tool-carrier plate is performing its forward motion from the first position to the second position, said periodically maintained high position being done at a frequency that constitutes one of the operating parameters entered via the input means of the electronic circuit.

10. Apparatus according to claim 1, including transfer means bringing the sheet from a preceding station to the launching means, wherein the transfer means are driven by a third independent motor having electronic servo-control and connected to the electronic circuit, and monitoring means mounted on sheet displacement members of the preceding station and connected to said electronic circuit, and wherein said electronic circuit is programmed so that firstly the speed of the transfer means is constantly equal to the speed of the sheet leaving the sheet displacement members of the preceding station, and secondly the launching means are controlled as a function of said speed so that the sheet has the same speed as the peripheral linear speed of the backing cylinder on reaching the tool-carrier plate.

11. Apparatus for cutting semi-rigid sheets one by one, comprising:

a) a cutting tool, a tool-carrier plate and a backing cylinder, the cutting tool fixed on the tool-carrier plate, the tool-carrier plate being driven with forward-and-return reciprocating motion between a first position where the cutting tool is situated upstream from the backing cylinder and a second position where the cutting tool is situated downstream from the backing cylinder, and launching means for feeding sheet, the sheet being inserted by the launching means onto the cutting tool when the tool-carrier plate has left the first position, the sheet being cut as it passes under the backing cylinder and then removed from the cutting tool when the tool-carrier plate is in its second position, wherein the backing cylinder comprises a chassis and support means suitable for receiving a steel covering of thickness $d_1$ and a covering of flexible material of thickness $d_2$, wherein the backing cylinder is fitted simultaneously with said steel and flexible material coverings, one of said coverings constituting a backing surface and the other being in a standby position, wherein the support means include a first support means suitable for receiving the covering constituting the backing surface during cutting, the first support means formed by a curved metal sheet disposed at a first position at a distance R from the axis of rotation of the backing cylinder, and a second support means suitable for receiving the standby covering, the second support means constituted by a curved metal sheet disposed at a second position at a distance r that is less than R from the axis of rotation of the backing cylinder, and wherein displacement means are provided for displacing the two coverings radially relative to their respective support means and for displacing said support means angularly so as to interchange the coverings;

b) vertical displacement means for displacing the backing cylinder between two positions adjusted for receiving one of the coverings for cutting purposes, the first corresponding to the thickness $d_1$, and the second corresponding to the thickness $d_2$;

c) at least one first independent motor having electronic servo-control and rotatable in either direction, driving the tool-carrier plate in reciprocating motion, and a second independent motor having electronic servo-control driving the launching means; and d) monitoring means for monitoring rotation of the backing cylinder;

wherein said first and second motors, the monitoring means, and the vertical displacement means for the backing cylinder are connected to a controlling electronic circuit that has input means for receiving operating parameters including at least the thickness $d_1$ and $d_2$ of the coverings; and wherein said controlling electronic circuit is programmed to control the vertical displacement means for displacing the backing cylinder as a function of the thickness parameter, and for controlling the first and second motors so that the linear speed of the launching means and that of the tool-carrier plate are equal to the peripheral linear speed of the backing cylinder at the moment when the cutting tool presents the sheet under the backing cylinder, and so that the linear speed of the tool-carrier plate is equal to the peripheral linear speed of the backing cylinder so long as the cutting tool is in contact with said backing cylinder.

12. Apparatus according to claim 11, wherein the coverings are secured at each end to the chassis by means of a plurality of rods, ends of the chassis respectively provided with wheels, wherein the ends of the chassis include a concentric rail forming a running a track for said wheels, wherein the covering displacement means are constituted by actuators that include sliders and said rods, each of said sliders constituted by two short length rails forming alternatively a part of the concentric rail, and wherein said actuators are operable between:

a) a first position in which the rods are retracted and the wheels are received in the short length rails closer to the axis of rotation of the backing cylinder; the coverings are pressed against their respective support sheets, and the short length rails containing the wheels are retracted beneath the track; and b) a second position in which the rods are extended, with the coverings being moved away from the support sheets and the short length rails containing the wheels are in alignment with the concentric rail on the ends of the chassis.

13. Apparatus according to claim 11, wherein the covering displacement means are constituted by a third independent motor having electronic servo-control that rotates the backing cylinder, and means for temporarily locking the coverings.

14. Apparatus according to claim 13, wherein the third independent motor, the locking means, and the actuators are connected to the controlling electronic circuit, and wherein said circuit is programmed so as to cause the following operations to be performed in succession: firstly the rods of the actuators are extended; then the coverings are locked, then the cylinder is rotated, then the coverings are unlocked, and finally the rods of the actuators are retracted.

* * * * *